United States Patent [19]

Martini et al.

[11] 4,447,350

[45] May 8, 1984

[54] MIXTURES OF OPTICAL BRIGHTENERS AND THEIR USE

[75] Inventors: Thomas Martini, Bad Soden am Taunus; Erich Schinzel; Hans Frischkorn, both of Hofheim am Taunus; Herbert Friedrich, Heusenstamm; Heinz Probst, Sulzbach, all of Fed. Rep. of Germany

[73] Assignee: Hoechst Aktiengesellschaft, Fed. Rep. of Germany

[21] Appl. No.: 532,809

[22] Filed: Sep. 15, 1983

Related U.S. Application Data

[63] Continuation of Ser. No. 283,499, Jul. 15, 1981, abandoned.

[30] Foreign Application Priority Data

Jul. 19, 1980 [DE] Fed. Rep. of Germany ..... 3027479

[51] Int. Cl.[3] ..... C11D 7/26; D06L 3/12

[52] U.S. Cl. ..... 252/301.22; 252/301.28; 252/301.29; 252/301.32

[58] Field of Search ..... 252/301.28, 301.29, 252/301.32, 301.22

[56] References Cited

U.S. PATENT DOCUMENTS

| | | | |
|---|---|---|---|
| 3,336,330 | 8/1967 | Schinzel et al. | 252/301.28 X |
| 4,006,158 | 2/1977 | Fleck et al. | 252/301.29 X |
| 4,245,007 | 1/1981 | Guglielmetti | 252/301.28 X |
| 4,263,441 | 4/1981 | Pintschovius et al. | 252/301.28 X |
| 4,330,427 | 5/1982 | Martini et al. | 252/301.22 X |
| 4,336,155 | 6/1982 | Martini et al. | 252/301.22 X |
| 4,400,294 | 8/1983 | Martini et al. | 252/301.24 |

FOREIGN PATENT DOCUMENTS

| | | | |
|---|---|---|---|
| 1301791 | 8/1969 | Fed. Rep. of Germany | 252/301.28 |
| 52-68229 | 6/1977 | Japan | 252/301.28 |
| 52-31465 | 8/1977 | Japan | 252/301.26 |

*Primary Examiner*—F. Edmundson

*Attorney, Agent, or Firm*—Connolly and Hutz

[57] ABSTRACT

Mixtures of optical brighteners consisting of 1 to 60% by weight of a brightener from the bisbenzoxazolylnaphthalene series and 99 to 40% by weight of one or more brighteners of the formulae 2 to 10 listed in the description.

6 Claims, No Drawings

MIXTURES OF OPTICAL BRIGHTENERS AND THEIR USE

This application is a continuation of Ser. No. 283,499 filed July 15, 1981, now abandoned.

The present invention relates to mixtures of optical brighteners consisting of 1 to 60% by weight of a compound of the formula (1)

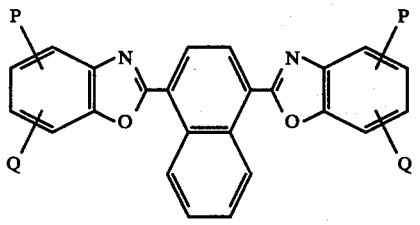

(1)

in which P and Q independently of one another denote halogen, alkyl, phenyl, carbalkoxy, alkylsulfonyl or trifluoromethyl, but preferably hydrogen, and 99 to 40% by weight of one or more compounds of the formulae (2) to (10)

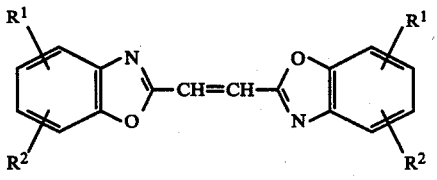

(2)

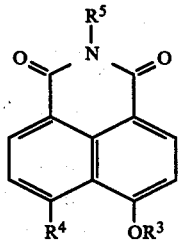

(3)

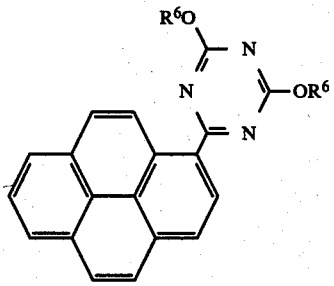

(4)

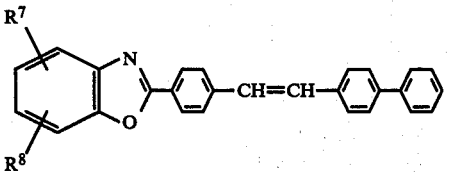

(5)

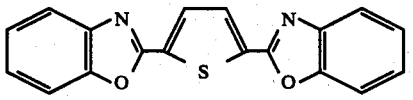

(6)

-continued

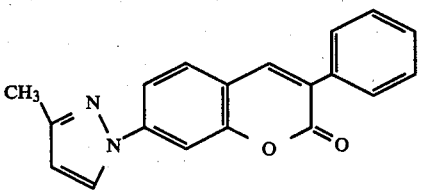

(7)

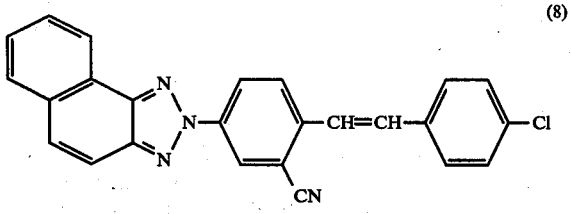

(8)

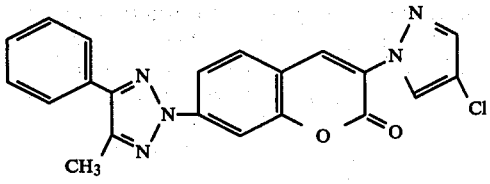

(9)

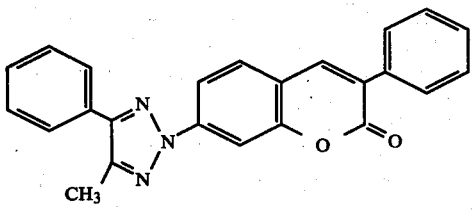

(10)

in which $R^1$ and $R^2$ independently of one another denote hydrogen or alkyl, $R^3$ denotes alkyl or alkoxyalkyl, $R^4$ denotes hydrogen or alkoxy, $R^5$ denotes alkyl, hydroxyalkyl, alkoxyalkyl or aralkyl, $R^6$ denotes alkyl and $R^7$ and $R^8$ denote hydrogen or alkyl.

Preferred compounds of the formulae (1) and (2) are those in which the substituents are in the 5- and 6-position of the benzoxazolyl ring; preferred compounds of the formula (5) are those which have the substituents in the 5- and 6-position or the 5- and 7-position. Alkyl and alkoxy groups in each case contain 1 to 4 C atoms. Benzyl is the preferred aralkyl group.

The mixing ratio of the brighteners is between 1 and 60% by weight of the compound of the formula (1) to, accordingly, 99 to 40% by weight of the compounds of the formulae (2) to (10). The optimum mixing ratio in an individual case depends on the nature of the particular compounds of the formulae (1) to (10) and can esily be determined by simple experiments. A mixing ratio of 2 to 25% by weight of the compounds of the formula (1) to, accordingly, 75 to 98% by weight of the compounds of the formulae (2) to (10) is preferred. Instead of in each case only a single compound of one of the formulae (2) to (10), it is also possible to use mixtures of these compounds with one another, in which case the mixing ratio of these compounds (2) to (10) is completely uncritical and can assume any value. Preferred compounds of the formulae (2) to (10) are those of the formulae (2) and (3).

As is customary for optical brighteners, the individual components are converted into the commercial form by being dispersed in a solvent. It is possible to disperse each of the individual components by itself and then to bring together the two dispersions. However, it is also possible for the two individual components to be mixed with one another as such and then to be dispersed together. This dispersion operation is effected in the customary manner in ball mills, colloid mills, bead mills or dispersion kneaders.

The mixtures according to the invention are particularly suitable for brightening textile material of linear polyesters, polyamides and acetylcellulose. However, these mixtures can also successfully be used on mixed fabrics comprising linear polyesters and other synthetic or natural fibers, for example fibers containing hydroxyl groups, especially cotton. These mixtures are applied under the conditions customary for the use of optical brighteners, thus, for example, by the exhaustion process at 90° C. to 130° C., with or without the addition of accelerators (carriers), or by the thermosol process. The water-insoluble brighteners and the mixtures according to the invention can also be used as solutions in organic solvents, for example perchloroethylene or fluorinated hydrocarbons. In this case, the textile material can be treated in the exhaustion process with the solvent liquor, which contains the dissolved optical brightener, or the textile material can be impregnated, padded or sprayed with solvent liquor containing brightener and then dried at temperatures of 120°–220° C., whereupon all the optical brightener becomes fixed in the fiber.

The mixtures according to the invention have the advantage that exceptionally high increases in the whiteness of brighteners (2)–(10) can already be achieved by adding relatively small amounts of the brightener of the formula (1). These increases in the whiteness mean a considerable saving of brightener substance. For example, in the case of a mixture of in each case 90% of a compound of the formula (2) or (3) and 10% of a compound of the formula (1), about half the amount of active substance is required in comparison with the pure compounds (2) or (3).

EXAMPLE 1

100 mg of the brightener of the formula

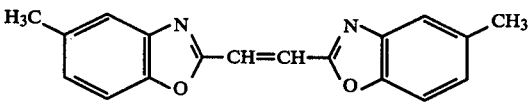

(2)

or 100 mg of a mixture of this brightener and a brightener of the formula

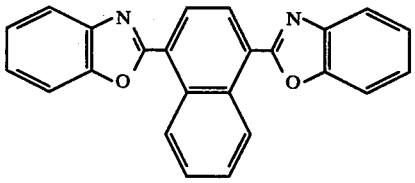

(1)

are dissolved in 5 ml of dimethylformamide, and 5 ml of a dispersing agent are added. The resulting solution is then stirred into an amount of water such that the resulting dispersion has an active substance concentration of 1 g/l. A polyester staple fiber fabric is impregnated with this dispersion, squeezed off between rollers to a moisture content of 80%, relative to the weight of material, dried at 110° C. and subjected to the thermosol process at 170° C. for 40 seconds. The Ganz whitenesses thereby achieved are summarized in the following table:

| | | | | |
|---|---|---|---|---|
| Parts by weight of brightener (1) | 0 | 10 | 20 | 30 |
| Parts by weight of brightener (2) | 100 | 90 | 80 | 70 |
| Whiteness (Ganz) | 186 | 206 | 214 | 216 |

EXAMPLE 2

A 23% strength commercially available dispersion of the brightener of the formula

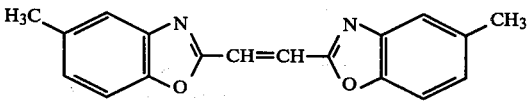

(2)

and an approximately 10% strength polyvinyl alcohol dispersion of the brightener of the formula

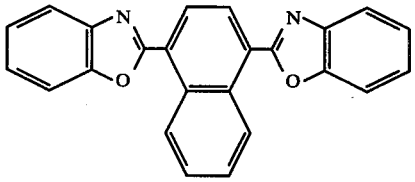

(1)

are mixed and diluted with one another in a ratio such that, overall, a 7% strength dispersion containing 10 parts by weight of the brightener 1 and 90 parts by weight of the brightener 2 is obtained. A polyester staple fiber fabric is treated with this dispersion in a liquor ratio of 1:20 in the presence of 2.5 g/l of $NaClO_2$ (50% strength) and 1 g/l of a dispersing agent by the high-temperature process at 110° C. for 60 minutes. The following Berger whitenesses (WB) and Stensby whitenesses (WS) are thereby obtained:

| % by weight of active brightener substance, relative to the weight of material | Brightener mixture (1) and (2) | | Only brightener (2) | |
|---|---|---|---|---|
| | WB | WS | WB | WS |
| 0.5 | 144 | 150 | 140 | 147 |
| 0.71 | 147 | 152 | 143 | 150 |
| 1.02 | 149 | 155 | 146 | 152 |
| 1.43 | 152 | 157 | 147 | 154 |
| 2.0 | 154 | 158 | 149 | 155 |

The higher whitenesses of the mixture demonstrate the advantage compared with the individual components of the formula (2).

EXAMPLE 3

A 10% strength polyvinyl alcohol dispersion of the compound of the formula

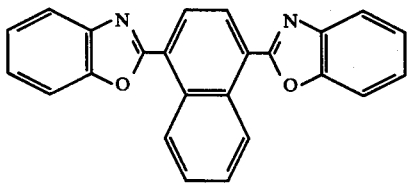

(1)

is mixed with a commercially available brightener of the formula

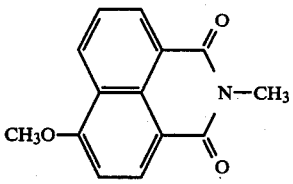

(3)

such that mixtures of the brighteners (1) and (3) in the ratios 10:90, 20:80 and 70:30 are obtained. 1% strength brightener liquors are prepared with these mixtures in the manner described in Example 1, and polyester staple fiber fabric is treated with these liquors, also as described in Example 1. The fabric is subjected to the thermosol process at 200° C. for 30 seconds. The following Berger whitenesses (WB) and Stensby whitenesses (WS) are obtained:

Brightener mixture in the ratio

| | (1) (3) 10:90 | (1) (3) 20:80 | (1) (3) 30:70 | (1) (3) 0:100 |
|---|---|---|---|---|
| WB | 147 | 152 | 155 | 134 |
| WS | 144 | 147 | 159 | 135 |

The advantage of the mixtures compared with compound (3) when employed in the same amount can clearly be seen.

EXAMPLE 4

A liquor is prepared from 5 parts by weight of the brightener of the formula

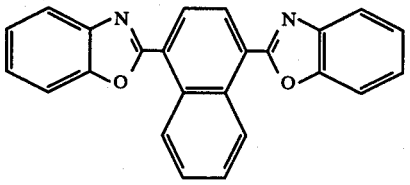

(1)

and 95 parts by weight of the brightener of the formula

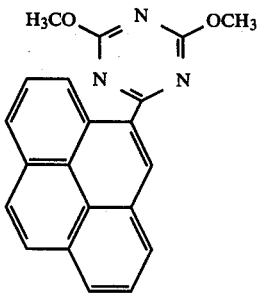

(4)

as described in Example 1, the liquor containing 1 g/l of the mixture of the two brighteners. Polyester staple fiber fabric is padded with this liquor as described in Example 1 and subjected to the thermosol process at 200° C. for 30 seconds. The fabric thus treated has a Berger whiteness of 158 and a Stensby whiteness of 154. A Berger whiteness of 156 or a Stensby whiteness of 153 is achieved with the same amount of the brightener (4) by itself. The increase in whiteness achieved by the mixture can also be clearly detected visually.

EXAMPLE 5

A commercially available approximately 20% strength dispersion of the brightener of the formula

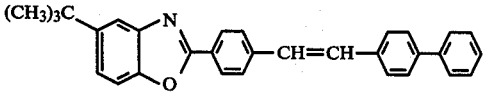

(5)

is mixed and diluted with a 10% strength polyvinyl alcohol dispersion of the brightener of the formula

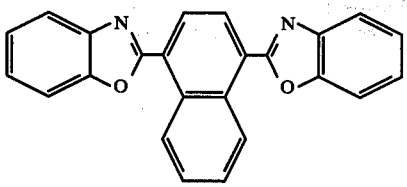

(1)

such that a 10% strength dispersion containing 80 or 70 parts by weight of the brightener of the formula (5) and, respectively, 20 or 30 parts by weight of the brightener of the formula (1) is obtained. This dispersion is diluted to a total content of the two brighteners of 1 g/l, and this liquor is applied to polyester as described in Example 1. The following Berger whitenesses (WB) and Stensby whitenesses (WS) are obtained:

| | Brightener mixture in the ratio (5) (1) 80:20 | (5) (1) 70:30 | Only brightener (5) |
|---|---|---|---|
| WB | 157 | 159 | 151 |
| WS | 151 | 152 | 147 |

Compared with the pure brightener (5), the mixtures clearly give a more brilliant effect.

EXAMPLE 6

The commercially available approximately 20% strength dispersion of the brightener (6) is mixed with an approximately 8% strength polyvinyl alcohol dispersion of the brightener of the formula

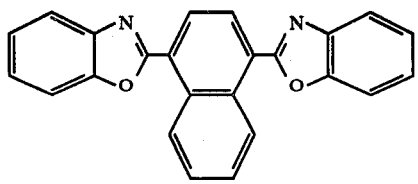

(1)

such that padding liquors containing the two brighteners in the concentrations given in the table which follows are obtained. Polyester staple fiber fabric is treated with these padding liquors under the conditions of Example 1. The following whitenesses are thus obtained:

| Concentration of brightener (6) | (1) in g/l | Berger whiteness | Stensby whiteness |
|---|---|---|---|
| 0.48 | 0.32 | 157 | 149 |
| 0.4 | 0.4 | 157 | 150 |
| 0.32 | 0.48 | 159 | 151 |
| 0.8 | — | 148 | 144 |
| — | 0.8 | 155 | 149 |

The whitenesses show that a pronounced synergistic effect is present here.

EXAMPLE 7

A commercially available dispersion of 68% by weight of a brightener of the formula (7) and 32% by weight of a brightener of the formula (8) is mixed with an 8% strength polyvinyl alcohol dispersion of the brightener of the formula (1) (P and Q=H) such that mixtures which each contain 10, 20 or 30% by weight of the brightener of the formula (1) and, accordingly, 90, 80 or 70% by weight of the abovementioned mixture of brighteners (7) and (8) are obtained. These dispersions are diluted to a content of 10 g/l and this liquor is applied to polyester staple fibers as described in Example 1. The fiber material is subjected to the thermosol process at 200° C. for 30 seconds. The following whitenesses are obtained:

| Mixture containing X % by weight of the brightener (1) X | Berger whiteness | Stensby whiteness |
|---|---|---|
| 10 | 153 | 150 |
| 20 | 155 | 151 |
| 30 | 156 | 151 |

Under the same conditions, the abovementioned mixture of brighteners (7) and (8) without brightener (1) has a whiteness of 149 (Berger) or 148 (Stensby). By adding the brightener, a shade is achieved which is significantly bluer than that achieved with the mixture of only brighteners (7) and (8).

EXAMPLE 8

A commercially available approximately 8.5% strength formulation of the brightener of the formula (9) is mixed with an 8% strength polyvinyl alcohol dispersion of the brightener of the formula (1) (P=Q=H) such that a dispersion containing 90 or 80% by weight of the brightener (9) and, respectively, 10 or 20% by weight of the brightener (1) is obtained. These dispersions are diluted to a brightener substance content of 10 g/l, and a polyester fabric is treated with this liquor as described in Example 1. The fabric is subjected to the thermosol process at 200° C. for 40 seconds. The following whitenesses are thus achieved:

| Brightener mixture (9) | (1) | Whiteness Berger | Stensby |
|---|---|---|---|
| 90% | 10% | 158 | 155 |
| 80% | 20% | 160 | 156 |

Using the same amount of brightener (9) by itself, whitenesses of only 156 (Berger) and 154 (Stensby) are achieved.

EXAMPLE 9

If the brightener (9) in Example 8 is replaced by the brightener of the formula (10) and the procedure is otherwise the same, the following whitenesses are obtained:

| Brightener mixture (10) | (1) | Whiteness Berger | Stensby |
|---|---|---|---|
| 90% | 10% | 154 | 148 |
| 80% | 20% | 156 | 149 |

Using the same amount of brightener (10) by itself, whitenesses of only 153 (Berger) and 147 (Stensby) are achieved.

EXAMPLE 10

0.05% by weight, relative to the weight of triacetate fabric (5 g) to be brightened, of the brightener of the formula 3

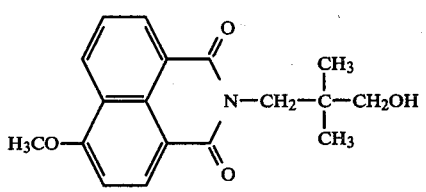

(3)

are dispersed in a closed vessel as described in Example 1. The triacetate fabric is treated with this dispersion in a liquor ratio of 1:20 at 98° C. for 60 minutes, with the addition of 2 g/l of 80% strength Na chlorite, 49 g/l of a commercially available buffer salt and 1 ml/l of 10% strength acetic acid.

The same experiment is carried out with 0.05% by weight, relative to the weight of material, of a mixture of 90% by weight of the brightener of the above formula 3 and 10% by weight of the brightener of the formula 1 (P=Q=H).

The whitenesses measured clearly show the advantage of the mixture:

| | WB | WS |
|---|---|---|
| Brightener 3 by itself | 125 | 126 |
| Mixture of brighteners 1 and 3 (10%:90%) | 129 | 129 |

If 1% by weight, relative to the weight of material, of the brightener 3 or of the brightener mixture is used, the following whitenesses are obtained:

| | WB | WS |
|---|---|---|
| Brightener 3 by itself | 131 | 132 |
| Mixture of brighteners 1 and 3 (10%:90%) | 135 | 135 |

EXAMPLE 11

Polyester fabric is treated with 1 g/l of the brightener of the formula 3 or of a brightener mixture of 90% by weight of the brightener 3 and 10% by weight of the brightener 1 as described under Example 1, and the fabric is subjected to the thermosol process at 180° C. for 40 seconds.

The following whitenesses were measured:

| | WB | WS |
|---|---|---|
| Brightener 3 by itself | 135 | 135 |
| Mixture of brighteners 3 and 1 (90%:10%) | 142 | 140 |

We claim:

1. Mixtures of optical brighteners consisting of 1 to 60% by weight of a compound of the formula (1)

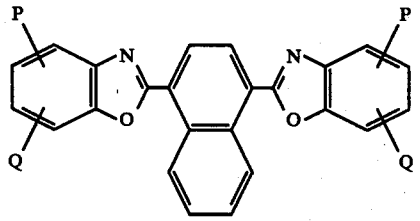

(1)

in which P and Q independently of one another denote alkyl, carbalkoxy, or alkylsulfonyl and 99 to 40% by weight of one or more compounds of the formulae (2) to (10)

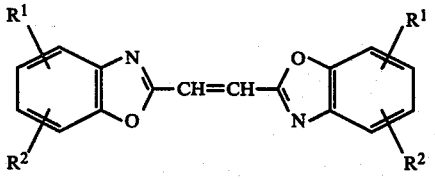

(2)

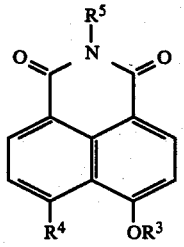

(3)

-continued

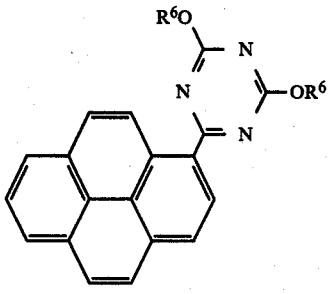

(4)

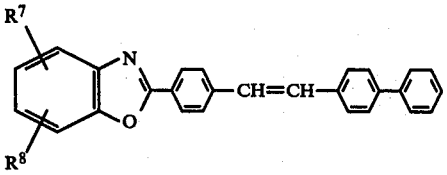

(5)

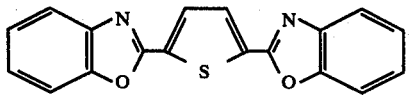

(6)

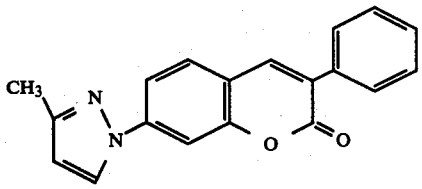

(7)

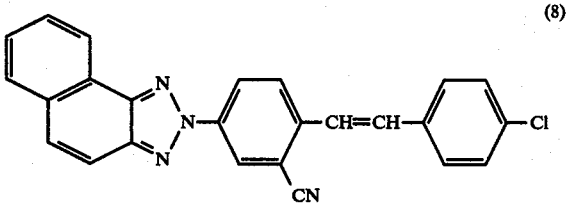

(8)

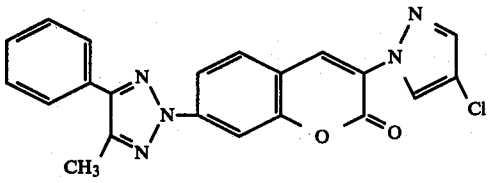

(9)

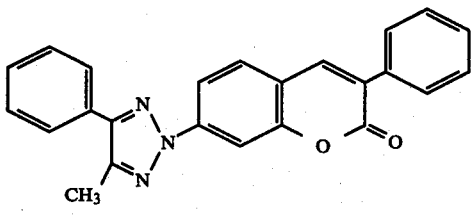

(10)

in which $R^1$ and $R^2$ independently of one another denote hydrogen or alkyl, $R^3$ denotes alkyl or alkoxyalkyl, $R^4$ denotes hydrogen or alkoxy, $R^5$ denotes alkyl, hydroxyalkyl, alkoxyalkyl or aralkyl, $R^6$ denotes alkyl and $R^7$ and $R^8$ denote hydrogen or alkyl, at temperatures of from 250° to 360° C.

2. Mixtures as claimed in claim 1, consisting of 2 to 25% by weight of a compound of the formula (1) and 92 to 75% by weight of a compound of one of the formulae (2) to (10).

3. Mixtures according to claim 1, consisting of a compound of the formula (1) and a compound of the formula (2) or (3).

4. Mixtures according to claim 1 wherein P and Q of formula (1) are both hydrogen.

5. Mixtures according to claim 4 wherein $R^1$ and $R^2$ denote alkyl; $R^3$ denotes alkyl; $R^4$ denotes hydrogen; $R^5$ denotes alkyl or hydroxyalkyl; $R^7$ denotes alkyl, and $R^8$ denotes hydrogen.

6. Mixtures according to claim 5 consisting of 2 to 25% by weight of a compound of the formula (1) and 92 to 75% by weight of a compound of one of the formulae (2) to (10).

* * * * *

UNITED STATES PATENT AND TRADEMARK OFFICE

CERTIFICATE OF CORRECTION

PATENT NO. : 4,447,350

DATED : May 8, 1984

INVENTOR(S) : Thomas Martini et al.

It is certified that error appears in the above-identified patent and that said Letters Patent is hereby corrected as shown below:

The term of this patent subsequent to August 18, 1999 has been disclaimed.

Signed and Sealed this

*Twenty-fourth* Day of *July 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,447,350

DATED : May 8, 1984

INVENTOR(S) : THOMAS MARTINI ET AL

It is certified that error appears in the above-identified patent and that said Letters Patent is hereby corrected as shown below:

In claims 1, 2, 3, and 6, in line 1 of each claim, for "consisting of" should read -- consisting essentially of --.

In claim 1, the last two lines thereof (column 10, lines 55 and 66 of the patent), ", at temperatures from 250° to 360°C" should be deleted.

Signed and Sealed this

*Twenty-third* Day of *April 1985*

[SEAL]

*Attest:*

DONALD J. QUIGG

*Attesting Officer* *Acting Commissioner of Patents and Trademarks*